US012528665B2

(12) United States Patent
Kim et al.

(10) Patent No.: US 12,528,665 B2
(45) Date of Patent: Jan. 20, 2026

(54) MOUNTING EQUIPMENT, HOLDING MODULE, AND METHOD FOR OPERATING MOUNTING EQUIPMENT

(71) Applicant: Samsung Electronics Co., Ltd., Suwon-si (KR)

(72) Inventors: Seung Geun Kim, Suwon-si (KR); Il Young Han, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 307 days.

(21) Appl. No.: 18/327,510

(22) Filed: Jun. 1, 2023

(65) Prior Publication Data

US 2024/0166468 A1 May 23, 2024

(30) Foreign Application Priority Data

Nov. 23, 2022 (KR) ..... 10-2022-0158316

(51) Int. Cl.
*B65H 75/18* (2006.01)

(52) U.S. Cl.
CPC ..... *B65H 75/18* (2013.01); *B65H 2701/37* (2013.01)

(58) Field of Classification Search
CPC ..... H05K 13/02; H05K 13/0419
See application file for complete search history.

(56) References Cited

U.S. PATENT DOCUMENTS

| | | | | | |
|---|---|---|---|---|---|
| 2,624,522 | A | * | 1/1953 | Van Hook | B65H 49/32 242/597.5 |
| 3,310,255 | A | * | 3/1967 | Sendzimir | B65H 20/24 228/5.1 |
| 4,489,901 | A | * | 12/1984 | Andersen | B65H 54/28 242/471 |
| 4,520,967 | A | * | 6/1985 | Andreasson | B65H 23/02 242/423.1 |
| 4,550,881 | A | * | 11/1985 | Boardman | B21C 47/26 242/532.6 |

FOREIGN PATENT DOCUMENTS

| | | | |
|---|---|---|---|
| JP | 4360894 | B2 | 11/2009 |
| JP | 5237402 | B2 | 7/2013 |
| JP | 20170538770 | A | 12/2017 |
| KR | 20050105011 | A | 11/2005 |
| KR | 20130088659 | A | 8/2013 |
| KR | 101421450 | B1 | 7/2014 |
| KR | 20180027059 | A | 3/2018 |
| KR | 101974344 | B1 | 5/2019 |

* cited by examiner

*Primary Examiner* — William A. Rivera
(74) *Attorney, Agent, or Firm* — Harness, Dickey & Pierce, P.L.C.

(57) ABSTRACT

A mounting equipment includes a frame, a holder on the frame, and includes a holding pin configured to hold a tape reel, and an electric cylinder on the frame, connected to the holder and configured to move a position of the holder.

20 Claims, 14 Drawing Sheets

MOUNTING EQUIPMENT, HOLDING MODULE, AND METHOD FOR OPERATING MOUNTING EQUIPMENT

CROSS-REFERENCE TO RELATED APPLICATION

This application claims priority from Korean Patent Application No. 10-2022-0158316 filed on Nov. 23, 2022 in the Korean Intellectual Property Office and all the benefits accruing therefrom under 35 U.S.C. 119, the contents of which in its entirety are herein incorporated by reference.

BACKGROUND

1. Field of the Invention

The present invention relates to mounting equipment, holding modules, and methods for operating mounting equipment.

2. Description of the Related Art

A surface mount device (SMD) is supplied with components by a component supply device during production (also called "feeder"), and mounts them on a PCB board. Various components designed by a customer may be mounted on the PCB board, and the appropriate components are supplied to and mounted on each component supply device. The components are typically supplied in the form of component reels, and are in the form in which pockets are provided in a long strip form made of paper or plastic and the components are contained in the pockets. There are various vendors even for the same components, and there are various reel types.

The reels may be managed with a reel management program called an IT System. All the reels have a unique serial barcode, and the barcode may be recognized and registered in the IT system to record various information such as a vendor type, a first-installed time, and a remaining amount in real time.

The feeder is configured to move the component reel to a component supply region (pickup position) and supply the components. When all the components are used up, there is a need to replace the component reel with a new one, a time loss occurs in the process of replacement to a new reel.

SUMMARY

Aspects of the present invention provide mounting equipment having improved product reliability.

Aspects of the present invention also provide holding modules having improved product reliability.

Aspects of the present invention also provide methods for operating a mounting equipment that may operate a mounting equipment having improved product reliability.

However, aspects of the present invention are not restricted to the one set forth herein. The above and other aspects of the present invention will become more apparent to one of ordinary skill in the art to which the present invention pertains by referencing the detailed description of the present invention given below.

According to some aspects of the present disclosure, there is provided a mounting equipment including a frame, a holder on the frame, and including a holding pin configured to hold a tape reel, and an electric cylinder on the frame, connected to the holder and configured to move a position of the holder.

According to some aspects of the present disclosure, there is provided a holding module including a base plate including a first fixed hinge and a second fixed hinge, a holder which is connected to the first fixed hinge, and includes a holding pin configured to hold a tape reel, and an electric cylinder which connects the second fixed hinge and the holder.

According to some aspects of the present disclosure, there is provided a method for operating a mounting equipment including providing a mounting equipment which includes a frame, a holder on the frame and including a holding pin configured to hold a tape reel, and an electric cylinder on the frame, the electric cylinder connected to the holder and configured to move a position of the holder, moving the holder from a first position to a second position lower than the first position by the electric cylinder to replace the tape reel, and moving the holder from the second position to the first position by the electric cylinder, based on the replacement of the tape reel being completed.

It should be noted that the effects of the present disclosure are not limited to those described above, and other effects of the present disclosure will be apparent from the following description.

BRIEF DESCRIPTION OF DRAWINGS

The above and other aspects and features of the present disclosure will become more apparent by describing in detail example embodiments thereof with reference to the attached drawings, in which.

DETAILED DESCRIPTION

Hereinafter, embodiments according to the technical concepts of the present invention will be described with reference to the accompanying drawings.

Figure 1:
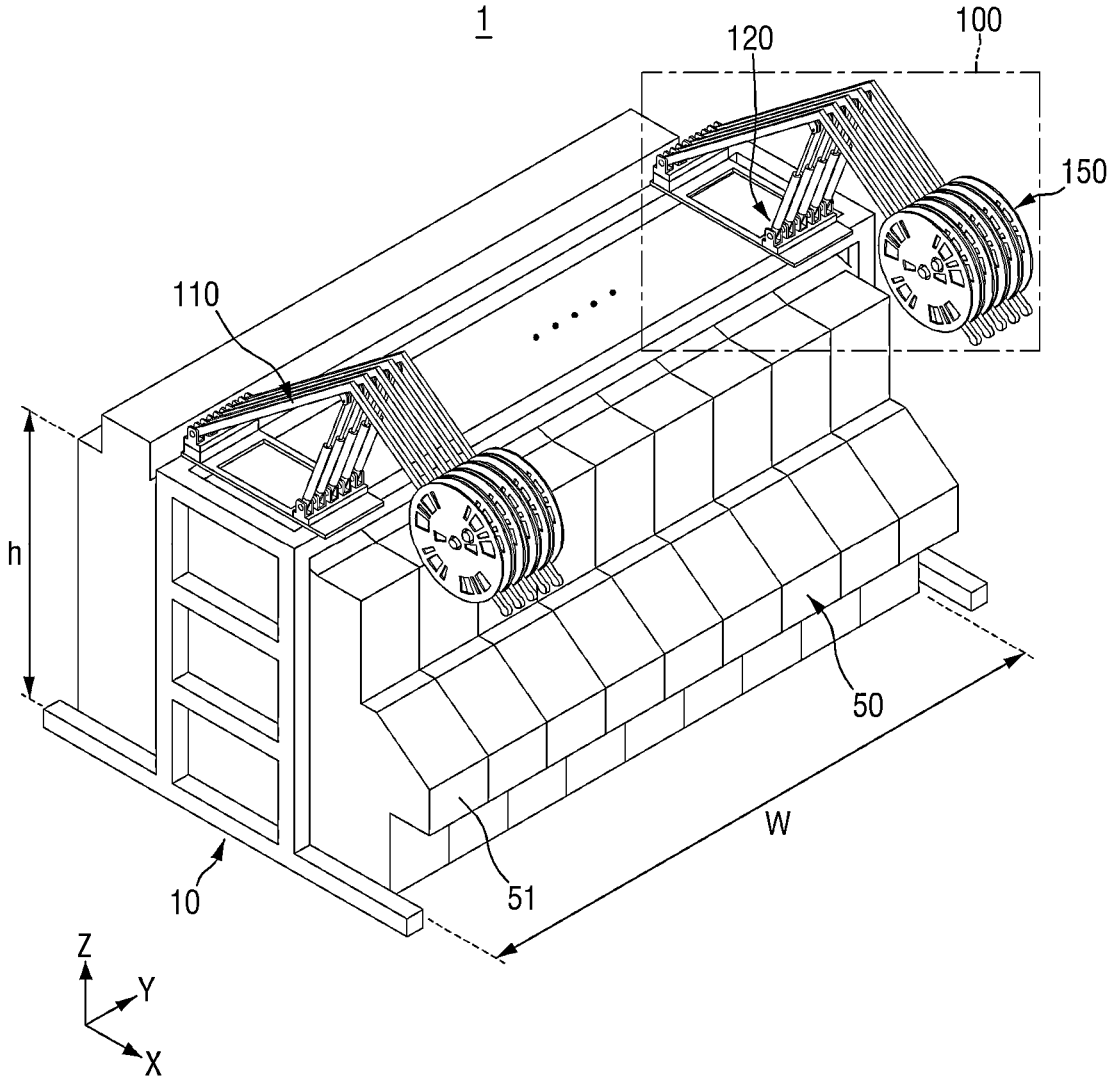
FIG. 1 is a perspective view of a mounting equipment according to some embodiments.

FIG. 1 is a perspective view of a mounting equipment according to some embodiments.

Referring to FIG. 1, a mounting equipment 1 may include a frame 10, a mounting facility 50, and a holding module 100 including a holder 110, an electric cylinder 120 and a tape reel 150.

In some embodiments, the frame 10 may be disposed to surround an upper surface and both side surfaces of the mounting facility 50 on the mounting facility 50, as shown in FIG. 1. Further, in some embodiments, the frame 10 may have a width that is identical to a length of the mounting facility 50 in a Y-direction, that is, a width W of the mounting facility 50. In addition, the frame 10 may have a height that is identical to a length of the mounting facility 50 in a Z-direction, that is, a height h of the mounting facility 50.

Although not shown in FIG. 1, the mounting facility 50 may include a feeder and a control unit. The feeder may pull the tape reel 150 to peel off plastic packaging that contains the components in the tape reel 150, pick up the components and mount them on the board. The control unit may sense when all the tape reels 150 in use are used up, and replace them with a new tape reel.

In some embodiments, the holding module 100 may include a holder 110, an electric cylinder 120, and a tape reel 150. Additionally, the holding module 100 may be placed on the frame 10 as shown in FIG. 1. Alternatively, one holding module 100 may be installed for each mount 51. As an example, as shown in FIG. 1, although nine holding modules 100 (omitted) may be installed and used in the mounting facility 50 including nine mounts 51, the embodiments are not limited thereto.

The holder 110, the electric cylinder 120, and the tape reel 150 will be described below in more detail with reference to FIGS. 2 and 3.

Figure 2:
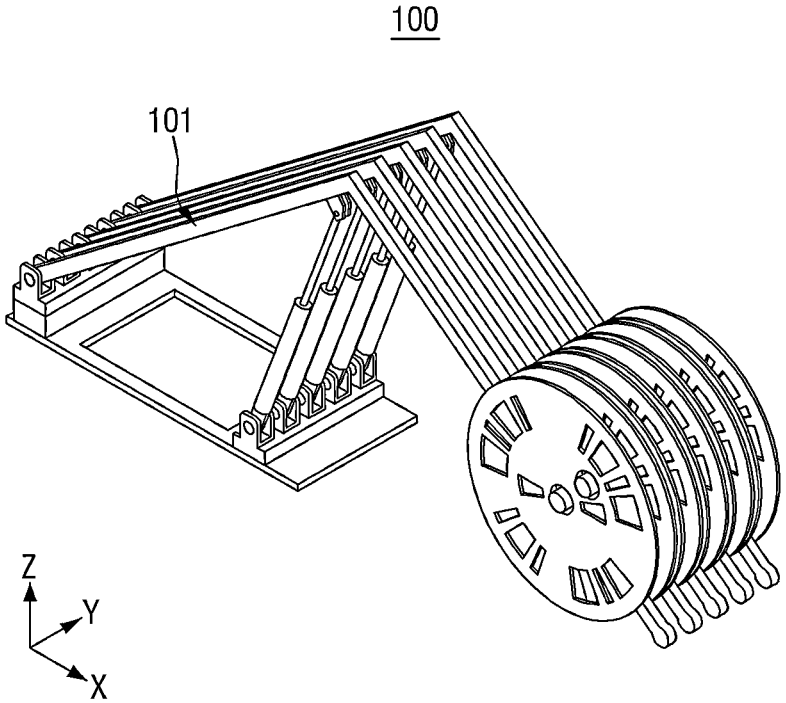
FIG. 2 is a perspective view of a holding module according to some embodiments.

FIG. 2 is a perspective view of a holding module according to some embodiments. FIG. 3 is a side view showing a tape reel holder according to some embodiments.

Referring to FIG. 2, although the holding module 100 may be made up five tape reel holders 101 in some embodiments, the embodiments are not limited thereto.

Figure 3:
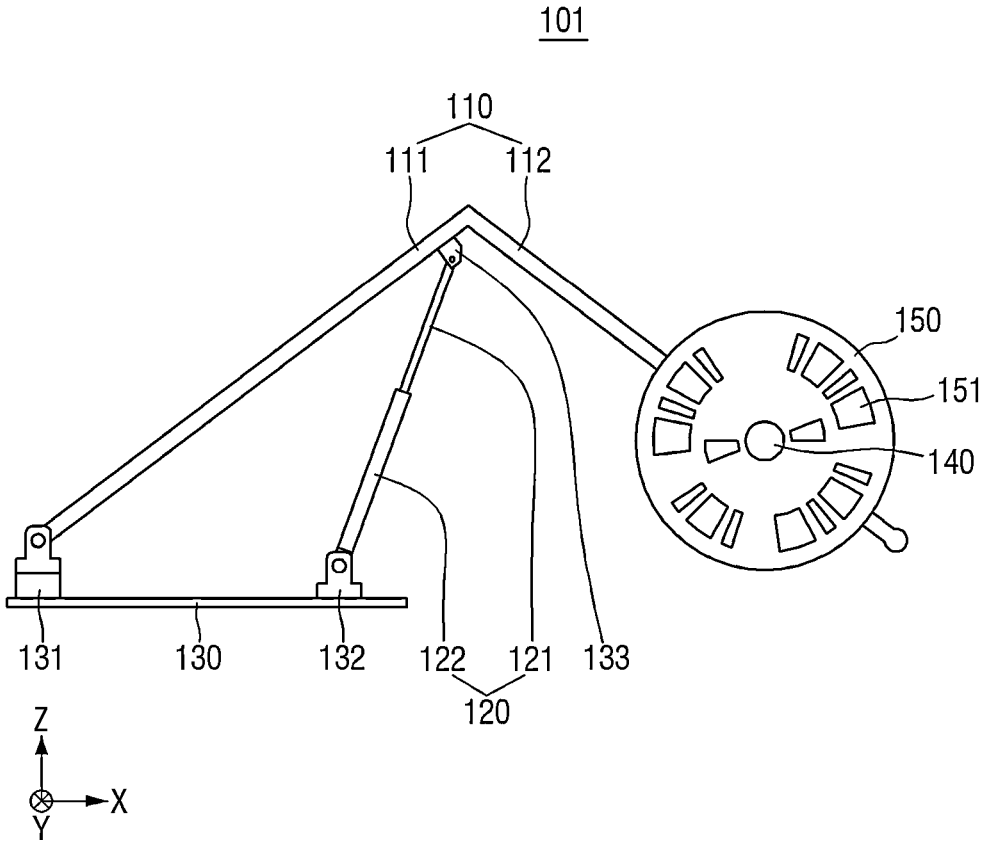
FIG. 3 is a side view showing a tape reel holder according to some embodiments.

Referring to FIG. 3, the tape reel holder 101 may include a holder 110, an electric cylinder 120, a base plate 130, a first fixed hinge 131, a second fixed hinge 132, a holding pin 140, and a tape reel 150.

The base plate 130 may be attached onto the frame 10 as shown in FIGS. 1 and 3. Additionally, in some embodiments, a plurality of tape reel holders (e.g., holder 101 of FIG. 2) may be placed on the base plate 130. Also, the base plate 130 may include a plurality of first fixed hinges 131 and a plurality of second fixed hinges 132. For example, as shown in FIGS. 2 and 3, the base plate 130 may include five first fixed hinges 131 and five second fixed hinges 132. Further, in some embodiments, the plurality of first fixed hinges 131 and the plurality of second fixed hinges 132 may each be arranged in a row on the base plate 130.

The holder 110 may include a first supporter 111 and a second supporter 112. As shown in FIG. 3, the first supporter 111 may be disposed on a left side on the basis of the electric cylinder 120 to be described later, and an end of the first supporter 111 may be connected to the first fixed hinge 131. Also, the second supporter 112 may be disposed on a right side on the basis of the electric cylinder 120, which will be described later.

The electric cylinder 120 may include a cylinder rod 121 and a rod cover 122. In some embodiments, one end of the cylinder rod 121 may be connected to the holder 110. For example, although the cylinder rod 121 may be connected to the first supporter 111 as shown in FIG. 3, the embodiments are not limited thereto. The rod cover 122 may be connected to the second fixed hinge 132. Moreover, the rod cover 122 may be configured to wrap (e.g., cover, hold, surround, etc.) the cylinder rod 121 when the cylinder rod 121 is pulled toward the rod cover 122.

The holding pins 140 may be disposed on both sides of the second supporter 112 in the Y-direction on the basis of the second supporter 112, as shown in FIG. 3. The tape reel 150 is in the form of a circle with a center hole, and the holding pin 140 may be fitted to the hole to hold the tape reel 150 on the holder 110. Further, in some embodiments, as the tape reel 150, not only a small capacity of tape reels (e.g., 7 inches, and 13 inches) may be used, but also a large capacity of tape reels (e.g., 22 inches) may be used even without additional modification. The tape reel 150 may also include a plastic packaging 151 that contains components to be mounted on the substrate.

Figure 4:
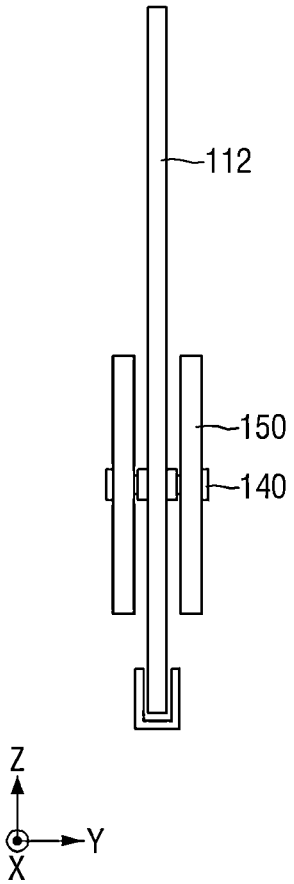
FIG. 4 is a front view of a tape reel holder according to some embodiments.
Figure 5:
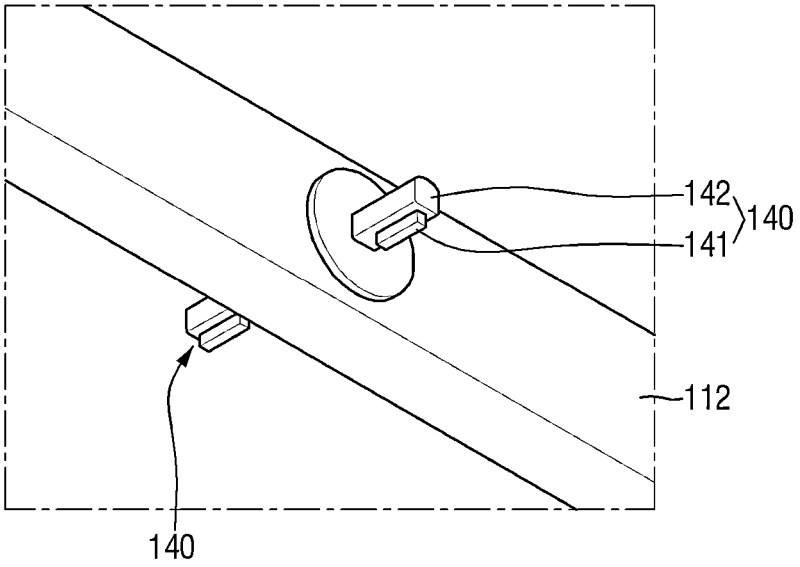
FIG. 5 is an enlarged view of a holding pin according to some embodiments.

FIG. 4 is a front view of a tape reel holder according to some embodiments. FIG. 5 is an enlarged view of a holding pin according to some embodiments.

Referring to FIGS. 2 to 4, the second supporter 112 of the holder 110 may have a form in which holding pins 140 are attached to both sides on the basis of the second supporter 112 in the Y-direction. Therefore, two tape reels 150 may be held on one tape reel holder 101. In other words, in some embodiments, the holding module 100 may be configured to use ten tape reels 150, as shown in FIG. 2. Also, in some embodiments, as shown in FIG. 1, in the case of a mounting facility 50 in which nine mounts 51 are operated in a set, since one holding module 100 is installed on one mount 51, ninety tape reels 150 may be used.

Referring to FIGS. 4 and 5, the holding pins 140 may include a lower holding pin 141 and an upper holding pin 142. In some embodiments, a width of the holding pin 140 is adjustable. For example, when the holding pin 140 is in a first state, the width of the holding pin 140 is greater than the width of the hole of the tape reel 150, and when the holding pin 140 is in a second state (e.g., the lower holding pin 141 is retracted or depressed into the upper holding pin 142), the width of the holding pin 140 is smaller than the width of the hole of the tape reel 150. More specifically, the holding pin 140 has a built-in biasing member (e.g., spring or elastic member), and when the lower holding pin 141 is pressed toward the upper holding pin 142 (corresponding to the second state), the lower holding pin 141 may enter the upper holding pin 142 to hold the tape reel 150 on the holding pin 140. That is, axial pressure on the lower holding pin 141 may cause the lower holding pin 141 to retreat or recess into the upper holding pin 142 such that the holding pin 140 has a consistent outer diameter. Subsequently, when the tape reel 150 is held on the holding pin 140, if the pressure applied to the lower holding pin 141 is removed, the force of the built-in spring may cause the lower holding pin 141 to return to an original position (corresponding to the first state). Therefore, the holding pin 140 presses the hole of the tape reel 150, and the tape reel 150 may be fixed to the holding pin 140 and may reduce or prevent shaking during rotation.

In some example embodiments the lower holding pin 141 may be connected to a rotating member (not shown) which retracts and extends the lower holding pin 141 into/out of the upper holding pin 142 based on a position of the rotating member. However, the embodiments are not limited thereto, and other methods of retracting and engaging the upper and lower holding pins 141 and 142 may be used.

Figure 6:
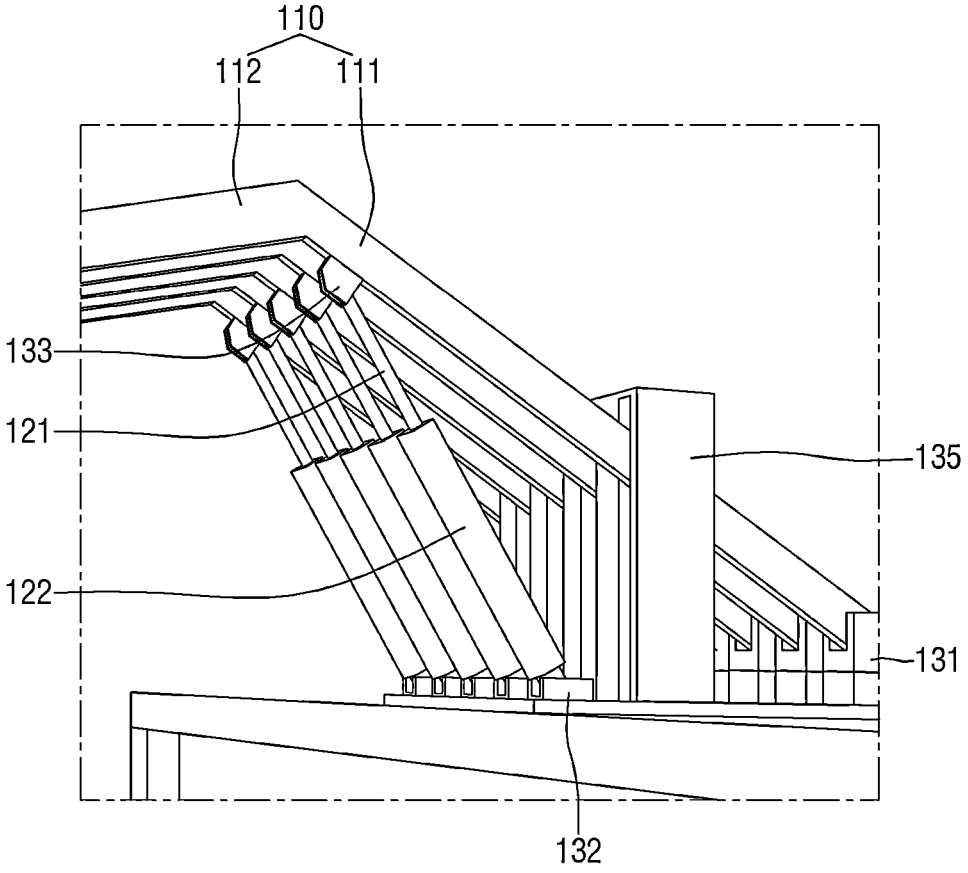
FIG. 6 is an enlarged view of the mounting equipment according to some embodiments.

FIG. 6 is an enlarged view of the mounting equipment according to some embodiments.

Referring to FIGS. 2 to 6, the base plate 130 may include a guide block 135. In some embodiments, the guide block 135 may be disposed between the first fixed hinge 131 and the second fixed hinge on base plate 130, and may be in the form that surrounds the first supporter 111 of the holder 110. Also, one guide block 135 may be disposed on one tape reel holder 101. For example, as shown in FIG. 6, in the holding module 100 including the five tape reel holders 101, five guide blocks 135 may be disposed so that when each tape reel holder 101 does not interfere with each other when moving up and down.

Referring to FIGS. 3 and 6, the first supporter 111 may include a third fixed hinge 133 that connects the first supporter 111 and the cylinder rod 121. In some embodiments, the third fixed hinge 133 may be in the form that wraps (e.g., cover, hold, surround, etc.) a part of the cylinder rod 121 as shown in FIG. 6.

Referring to FIG. 6, the portion to which the holder 110 or the electric cylinder 120 is connected, such as the first fixed hinge 131, the second fixed hinge 132, and the third fixed hinge 133, may have a bracket structure as shown in FIG. 6 so that a rotary motion may be performed smoothly.

Figure 7:
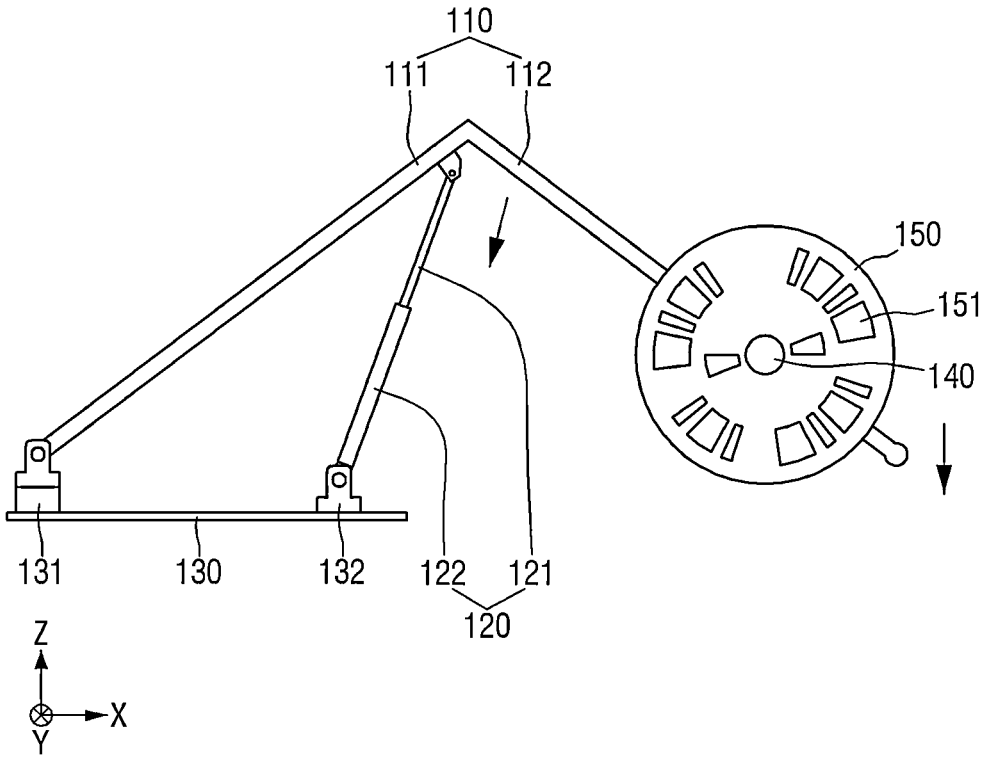
FIG. 7 is a side view showing an operation of a holding module according to some embodiments.
Figure 8:
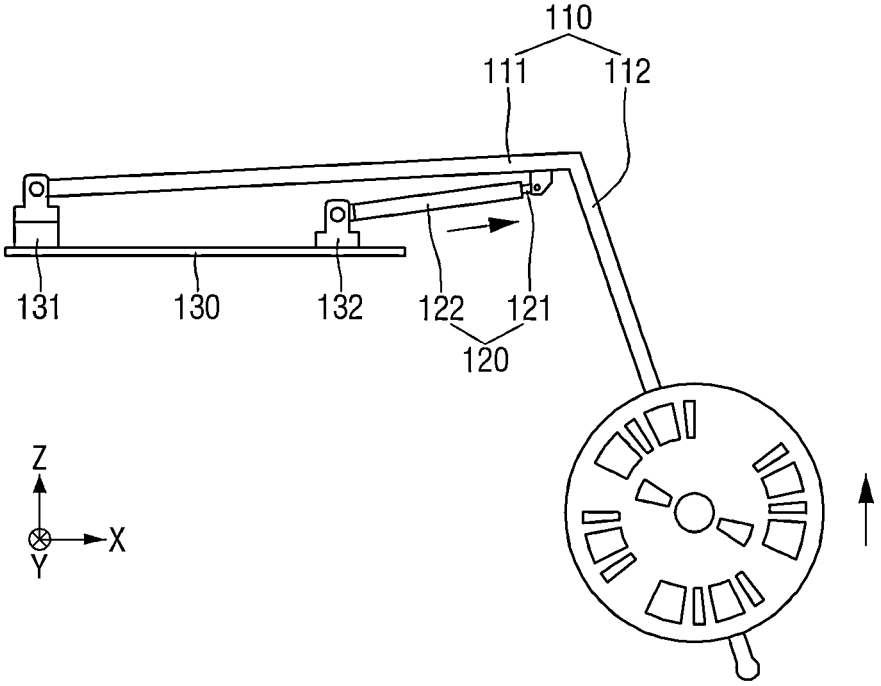
FIG. 8 is a side view showing an operation of the holding module according to some embodiments.

FIG. 7 is a side view showing an operation of a holding module according to some embodiments. FIG. 8 is a side view showing an operation of the holding module according to some embodiments.

Referring to FIG. 7, when the holder 110 needs to be moved to a low point to replace the tape reel 150, the cylinder rod 121 of the electric cylinder 120 may be pulled toward the rod cover 122 in a direction of an arrow. As a result, the tape reel 150 hanging on the holder 110 may be lowered in the direction of the arrow, and the position of the tape reel 150 may be maintained at a replaceable height. Further, according to some embodiments, although each tape reel holder (101 of FIG. 2) of the holding module (100 of FIG. 2) may operate independently, the embodiments are not limited thereto.

As shown in FIG. 8, the tape reels 150 may be replaced at the lowered height. When the replacement of the tape reel 150 is completed, the cylinder rod 121 of the electric cylinder 120 may protrude from the rod cover 122 in the direction of the arrow. As a result, the tape reel 150 hanging on the holder 110 may rise in the direction of the arrow, and the tape reel may maintain a height for mass production of products.

As shown in FIG. 1, in some embodiments of the inventive concepts of the mounting equipment 1, as the holding module 100 is installed at the upper end of the mounting facility 50 and the tape reel 150 is held on the upper end holding module 100, the tape reel 150 can be held regardless of the size thereof. For example, since the mounting equipment 1 of the present invention may use a large 22-inch tape reel 150, components to be supplied by four 13-inch tape reels can be supplied by the 22-inch tape reel 150 at a time. Therefore, since the time of replacing the tape reel 150 is relatively shorter than the equipment using the 13-inch tape reel, the working amount over time can be increased.

Also, as shown in FIG. 1, in the mounting equipment 1 of the present invention, since the holding module 100 is held in an empty space at the upper end of the equipment, it is possible to hold the tape reel 150 regardless of the size thereof, and therefore no modification of the size of the holder needs to be performed for holding a large-capacity tape reel 150 such as the 22-inch tape reel 150. As a result, since the mounting equipment 1 of the present invention does not need to secure a separate space and may store the tape reels 150 in the empty space at the upper end of the equipment, it is possible to improve a space utilization.

Figure 9:
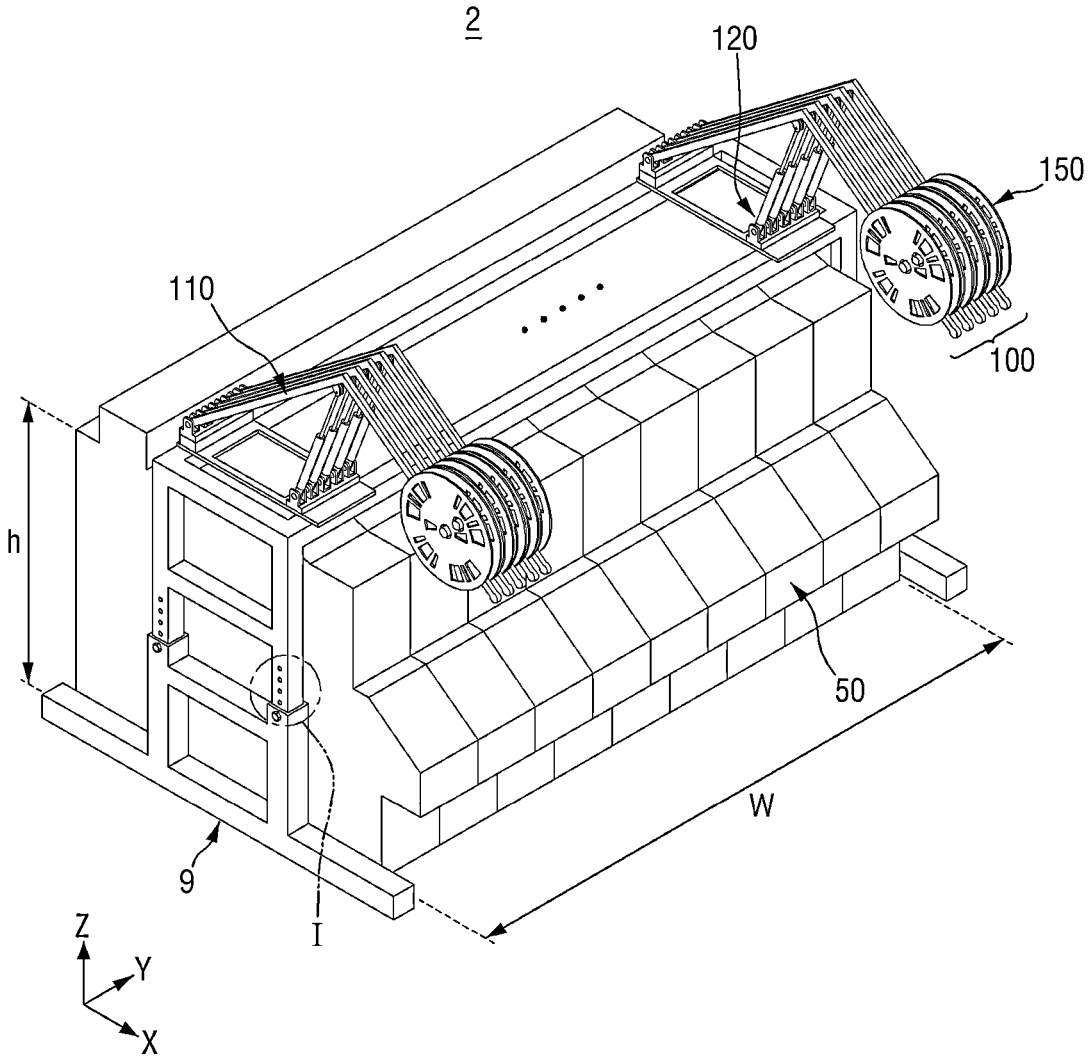
FIG. 9 is a perspective view of a mounting equipment according to some embodiments.
Figure 10:
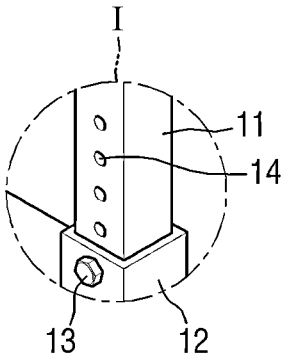
FIG. 10 is an enlarged view of portion I of the mounting equipment of FIG. 9.

FIG. 9 is a perspective view of a mounting equipment according to some embodiments. FIG. 10 is an enlarged view of section I of the mounting equipment of FIG. 9. For convenience of explanation, repeated parts of contents explained above using FIGS. 1 to 8 will be briefly explained or omitted.

Referring to FIGS. 9 and 10, the frame 9 may include an upper frame 11, a lower frame 12, a bolt 13, and bolt holes 14.

As shown in FIG. 10, in some embodiments, the upper frame 11 may include circular bolt holes 14 bored at regular intervals on one side. Also, a plurality of bolt holes 14 may be arranged in a row in the Z-direction, although other configurations of bolt holes 14 (for example, arranged in a zig-zagging pattern, curved pattern, etc.). Additionally, in some embodiments, a lower frame 12 having a width greater than the width of the upper frame 11 may be disposed below the upper frame 11. Thus, when adjusting the height of the frame 9, the lower frame 12 may surround a part of the upper frame 11 according to some embodiments. The lower frame 12 may have a form in which the bolt 13 is disposed on the side surface of the lower frame 12, as shown in FIG. 10. In some embodiments, although the bolt 13 may be in the form of a hexagonal pillar as shown in FIG. 10, the embodiments are not limited thereto. Also, when viewing the mounting equipment 2 toward the Y-direction, the bolt 13 and the plurality of bolt holes 14 may be arranged in a row on the frame 9 in the Z-direction. Further, in some embodiments, the bolt 13 may be engaged with one bolt hole 14 among the plurality of bolt holes 14. In some embodiments, a plurality of bolts 13 may be engaged with respective bolt holes 14.

In some embodiments, when a height adjustment of the frame 9 of the mounting equipment 2 is required, the bolt 13 engaged with an arbitrary bolt hole 14 may be pulled to separate the bolt 13 from the bolt hole 14. Subsequently, the upper frame 11 of the frame 9 may be pulled in the Z-direction to increase the height of the frame 9, and in contrast, the upper frame 11 of the frame 9 may be pushed toward the lower frame 12 side to lower the height of the frame 9. When the height adjustment of the frame 9 is completed, the bolt 13 may be engaged with the nearest bolt hole 14 to fix the upper frame 11 to the lower frame 12.

Since the holding module 100 on which the tape reel 150 is held is located at the upper end of the frame 9, as in the mounting equipment 1 shown in FIG. 1, the mounting equipment 2 shown in FIG. 9 has the same advantages as the mounting equipment 1. As an example, the tape reel 150 can be held regardless of the size of the tape reel 150, and the working amount over time can increase accordingly Also, in some embodiments, since the mounting equipment 2 shown in FIG. 9 may adjust the height h of the frame 9, there is no need to manufacture a new frame for any mounting equipment which has the same width W as and a different height h from the mounting facility 50. In other words, if the frame 9 is used, any mounting equipment having the same width W may be used only by adjusting the height h.

Figure 11:
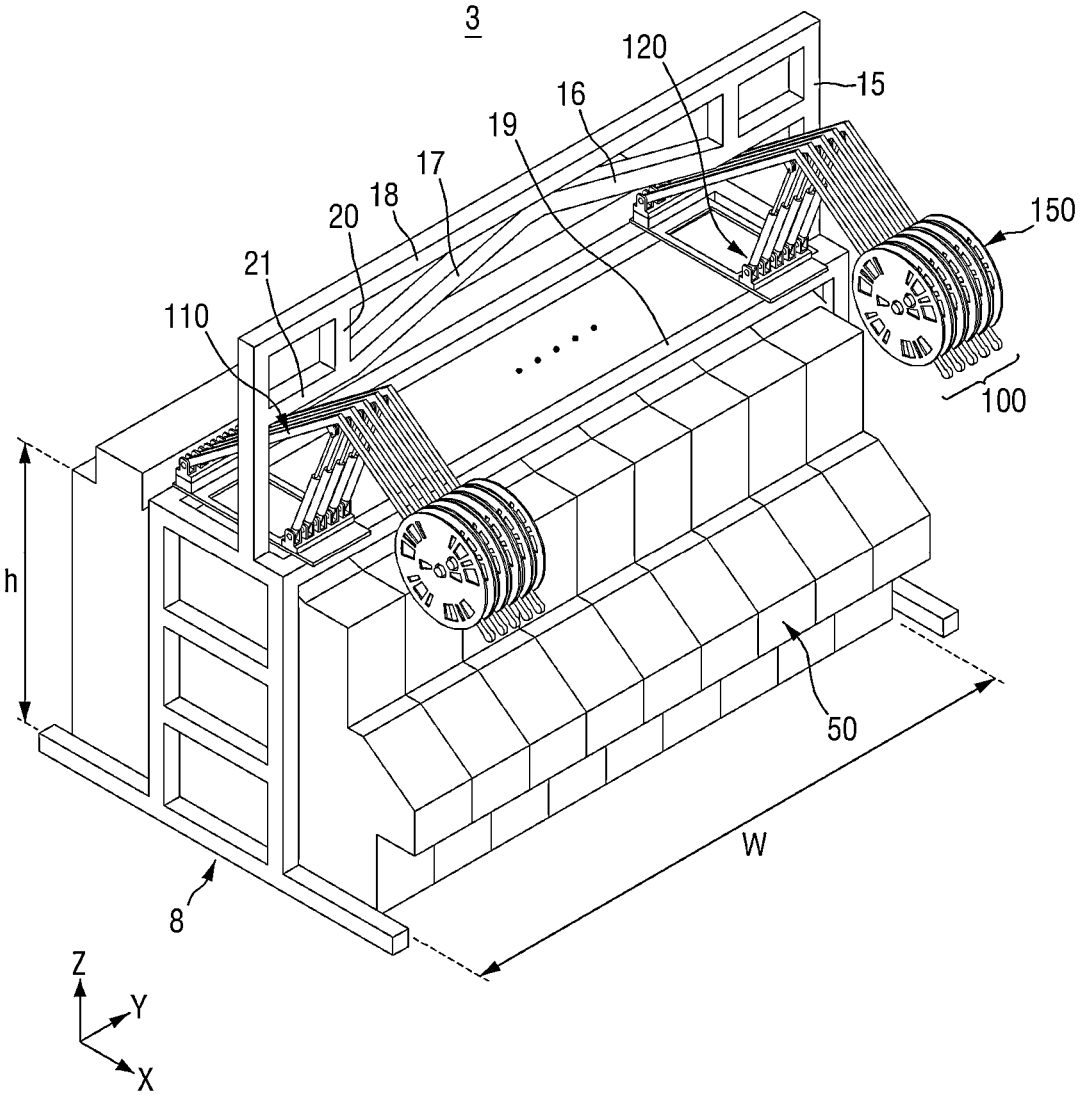
FIG. 11 is a perspective view of a mounting equipment according to some embodiments.

FIG. 11 is a perspective view of a mounting equipment according to some embodiments. For convenience of explanation, repeated parts of contents explained above using FIGS. 1 to 8 will be briefly explained or omitted.

Referring to FIG. 11, the frame 8 may include a frame supporter 15, a first diagonal bracing 16, a second diagonal bracing 17, a top chord 18, a lower chord 19, a first member 20, and a second member 21.

In some embodiments, as shown in FIG. 11, two frame supporters 15 may be spaced apart from each other on the frame 8 that surrounds the mounting facility 50 (see reference numeral W). Referring to FIGS. 3 to 11, although the frame supporter 15 may be disposed between the first fixed hinge 131 and the second fixed hinge 132 in some embodiments, the embodiments are not limited thereto. Additionally, the two frame supporters 15 may be connected to each other through the top chord 18.

In some embodiments, the first diagonal bracing 16 and the second diagonal bracing 17 may be disposed above the lower chord 19 and below the top chord 18. In some embodiments, one end of the first diagonal bracing 16 may be connected to the top chord 18, and the other end may be connected to the first member 20 and the second member 21. Further, in some embodiments, one end of the second diagonal bracing 17 may be connected to the top chord 18, and the other end may be connected to the first member 20 and the second member 21. Also, one ends of the first diagonal bracing 16 and the second diagonal bracing 17 may be connected to each other at the top chord 18.

In some embodiments, the first member 20 may be vertically connected to the top chord 18, and the first member 20 may be disposed below the top chord 18. Also, the second member 21 may be disposed below the top chord 18 and vertically connected to the first member 20. Also, the second member 21 may be vertically connected to the frame supporter 15, and the frame supporter 15 and the first member 20 may be disposed to be parallel to each other. Although not shown in FIG. 11, a guide block (135 of FIG. 6) may be disposed below the second member 21.

The mounting equipment 3 shown in FIG. 11 has the same advantages as the mounting equipment 1 as mentioned above, since the holding module 100 on which the tape reel 150 is held is located at the upper end of the frame 8, similarly to the mounting equipment 1 shown in FIG. 1. As an example, the tape reel 150 may be held regardless of the size of the tape reel 150, thereby increasing the working amount over time.

Also, if the holding module 100 is held at the top of the frame 8 for a long period of time in some embodiments, the lower chord 19 may be loaded. In this case, as shown in FIG. 11, since the frame 8 of the mounting equipment 3 is formed as a truss structure, members such as the frame supporter 15, the first diagonal bracing 16, the second diagonal bracing 17, the top chord 18, the first member 20 and the second member 21 may disperse and receive the load applied to the lower chord 19 together. Accordingly, the upper end of the frame 8 on which the holding module 100 is held may not hang down (e.g., may maintain its structure and not deform into due to the loaded lower chord 19) in the mounting equipment 3.

Figure 12:
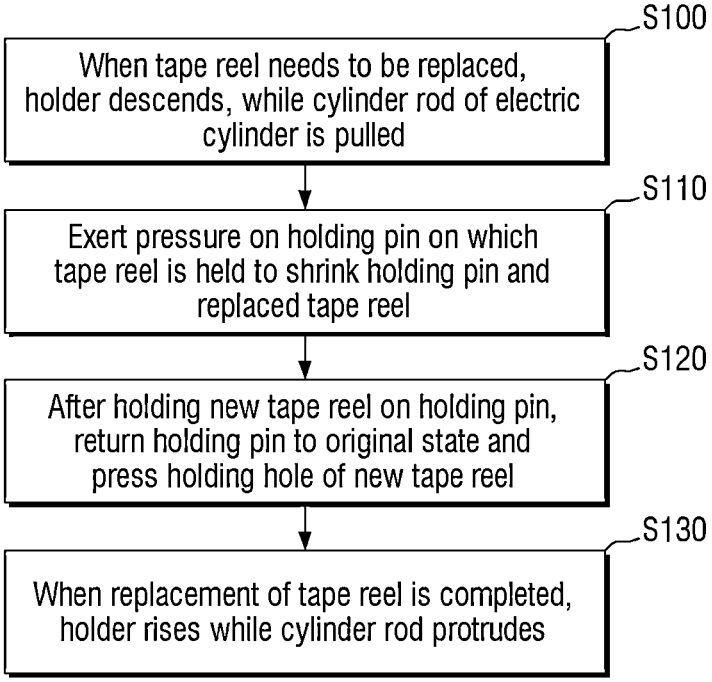
FIG. 12 is a flow chart showing a method for operating a mounting equipment according to some embodiments.
Figure 13:
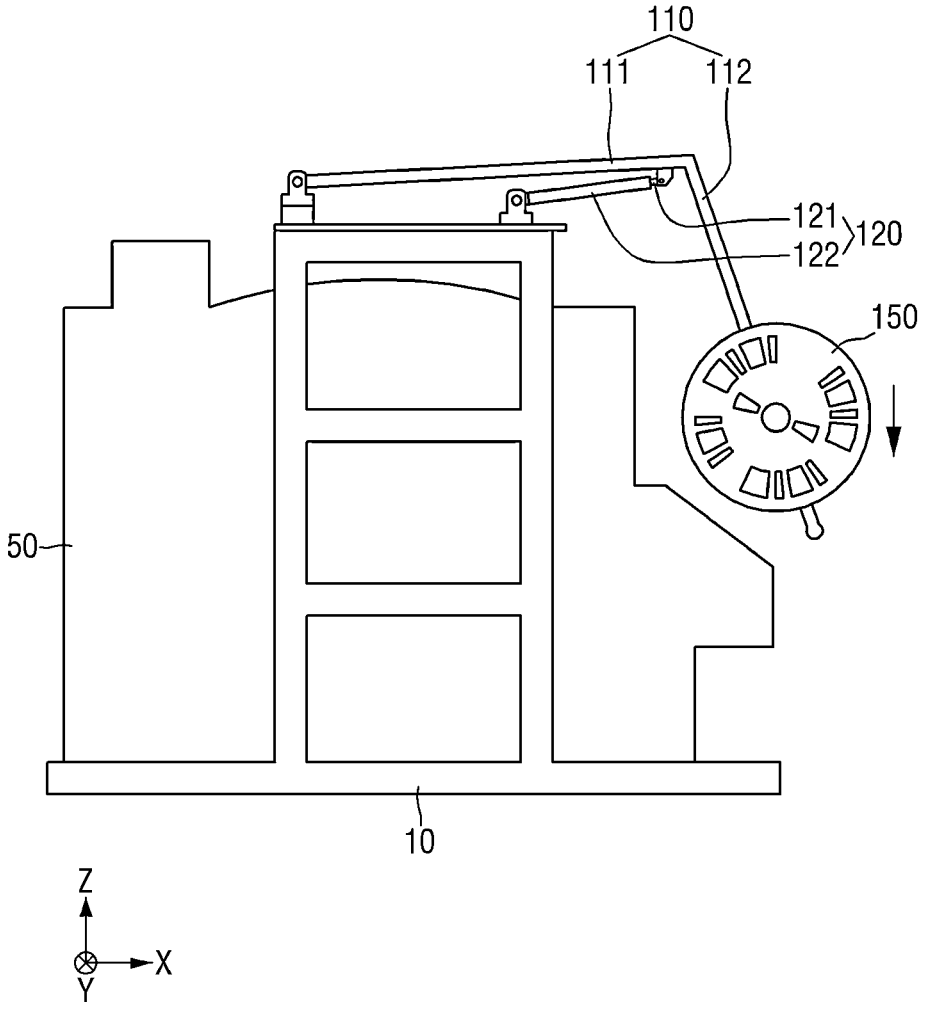
FIG. 13 is a diagram for explaining the method for operating the mounting equipment according to some embodiments.
Figure 14:
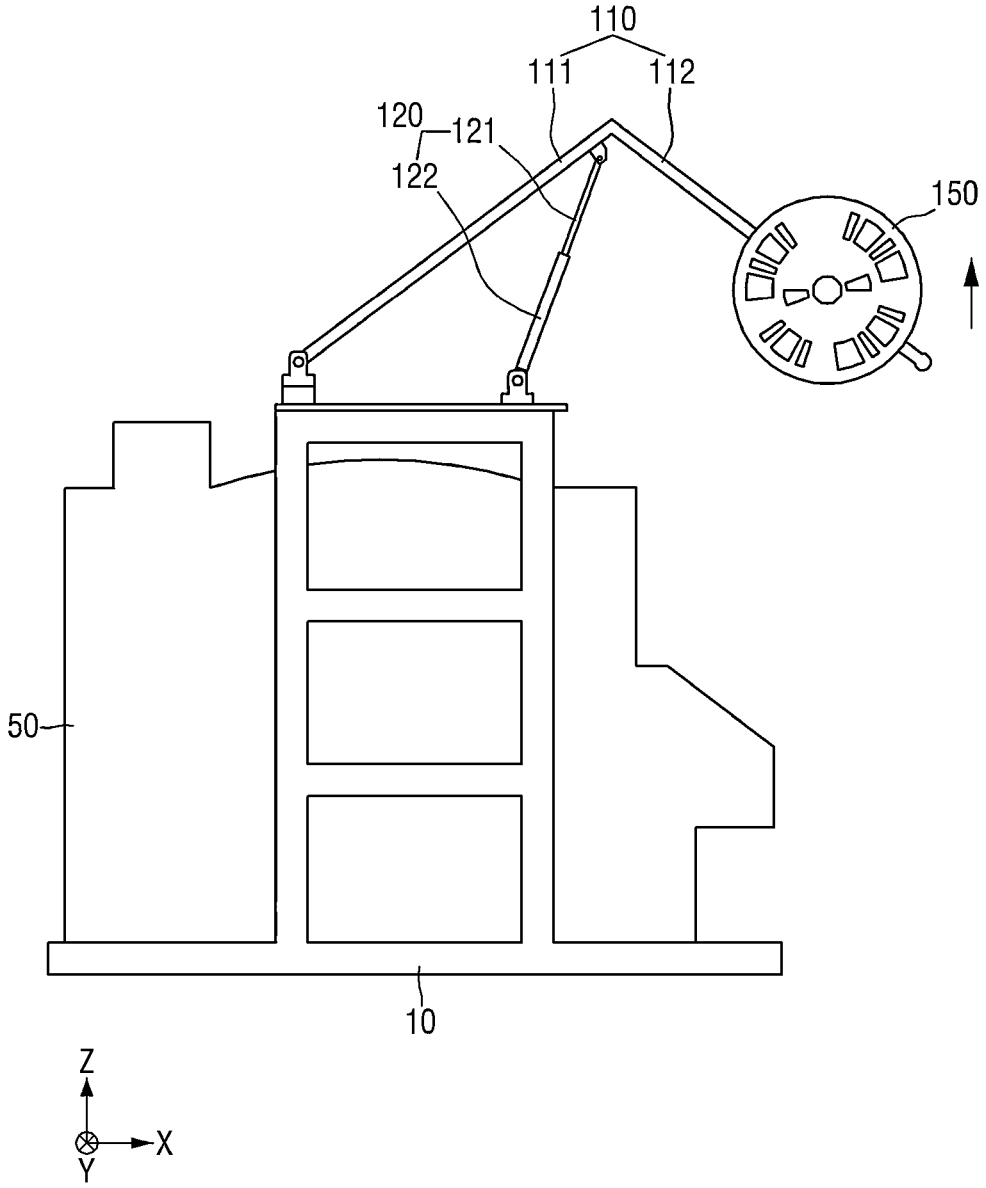
FIG. 14 is a diagram for explaining the method for operating the mounting equipment according to some embodiments.

FIG. 12 is a flow chart showing a method for operating a mounting equipment according to some embodiments. FIG. 13 is a diagram for explaining the method for operating the mounting equipment according to some embodiments. FIG. 14 is a diagram for explaining the method for operating the mounting equipment according to some embodiments.

Referring to FIGS. 5, 12, 13 and 14, when all the components inside the tape reel 150 are used up and the tape reel 150 needs to be replaced, while the cylinder rod 121 of the electric cylinder 120 is being pulled toward the rod cover 122, the holder 110 descends as shown in FIG. 13 (S100).

Subsequently, pressure is applied to the lower holding pin 141 of the holding pin 140 on which the tape reel 150 is held to shrink the holding pin 140 and replace the tape reel 150 (S110). For example, because the diameter of the holding pin 140 is larger than the hole of the tape reel 150, the diameter of the holding pin 140 may be reduced by applying a pressure to the lower holding pin 141 to shrink toward the upper holding pin 142 (e.g., sink or lower the lower holding pin 141 into the upper holding pin 142).

Subsequently, after a new tape reel 150 is held on the holding pin 140, the pressure applied to the holding pin 140 may be removed to return the holding pin 140 to its original state and press the hole of the new tape reel 150 (S120).

Finally, when the replacement of the tape reel 150 is completed, while the cylinder rod 121 of the electric cylinder 120 protrudes from the rod cover 122, as shown in FIG. 14, the holder 110 rises (S130).

When the terms "about" or "substantially" are used in this specification in connection with a numerical value, it is intended that the associated numerical value includes a manufacturing or operational tolerance (e.g., ±10%) around the stated numerical value. Moreover, when the words "generally" and "substantially" are used in connection with geometric shapes, it is intended that precision of the geometric shape is not required but that latitude for the shape is within the scope of the disclosure. Further, regardless of whether numerical values or shapes are modified as "about" or "substantially," it will be understood that these values and shapes should be construed as including a manufacturing or operational tolerance (e.g., ±10%) around the stated numerical values or shapes.

Although the embodiments of the present invention have been described above with reference to the accompanying drawings, the present invention is not limited to the above embodiments, and may be manufactured in various forms. Those skilled in the art will appreciate that the present invention may be embodied in other specific forms without changing the technical spirit or essential features of the present invention. Accordingly, the above-described embodiments are to be considered in all respects as illustrative and not restrictive.

What is claimed is:

1. A mounting equipment comprising:

a frame;

a holder on the frame, the holder including a first supporter and a second supporter, the second supporter including a holding pin configured to hold a tape reel; and an electric cylinder on the frame, connected to the holder and configured to move a position of the holder, wherein one end of the first supporter is on the frame, another end of the first supporter is connected to the electric cylinder, and one end of the second supporter is connected to the other end of the first supporter and the electric cylinder.

2. The mounting equipment of claim 1, further comprising:

a base plate attached to the frame, wherein the base plate includes a first fixed hinge connected to the holder, and a second fixed hinge connected to the electric cylinder.

3. The mounting equipment of claim 2, wherein the base plate includes:

a plurality of first fixed hinges arranged in a row along a first edge of the base plate, and a plurality of second fixed hinges arranged in a row along a second edge of the base plate opposite to the first edge.

4. The mounting equipment of claim 2, wherein one end of the electric cylinder is connected to the holder between the first fixed hinge and the holding pin, and the other end of the electric cylinder is connected to the second fixed hinge.

5. The mounting equipment of claim 4, wherein the holder includes a third fixed hinge, the holder and the electric cylinder are connected through the third fixed hinge, and the first fixed hinge, the second fixed hinge, and the third fixed hinge form a bracket structure.

6. The mounting equipment of claim 4, wherein another end of the second supporter includes the holding pin.

7. The mounting equipment of claim 6, wherein the base plate further includes a guide block which surrounds the first supporter, between the first fixed hinge and the second fixed hinge.

8. The mounting equipment of claim 1, wherein a length of the holder is longer than a length of the electric cylinder.

9. The mounting equipment of claim 1, wherein the holding pin includes an upper pin and a lower pin, and a width of the holding pin is configured to be adjustable based on the lower pin retracting into the upper pin.

10. The mounting equipment of claim 1, wherein the frame includes:

a first support which connects an upper surface of the frame and a first inner surface of the frame, and a second support which connects the upper surface of the frame and a second inner surface of the frame opposite to the first inner surface of the frame, and the first support and the second support form a truss structure in which they are in contact with each other on the upper surface of the frame.

11. A holding module comprising:

a base plate including a first fixed hinge and a second fixed hinge;

a holder including a first supporter connected to the first fixed hinge at one end of the first supporter and a second supporter including a holding pin configured to hold a tape reel; and an electric cylinder connecting the second fixed hinge and the holder, wherein another end of the first supporter is connected to the electric cylinder, and one end of the second supporter is connected to the other end of the first supporter and the electric cylinder.

12. The holding module of claim 11, wherein the base plate includes:

a plurality of first fixed hinges arranged in a row along a first edge of the base plate, and a plurality of second fixed hinges arranged in a row along a second edge of the base plate opposite to the first edge.

13. The holding module of claim 11, wherein another end of the second supporter includes the holding pin.

14. The holding module of claim 13, wherein the base plate further includes a guide block which surrounds the first supporter, between the first fixed hinge and the second fixed hinge.

15. The holding module of claim 11, wherein a length of the holder is longer than a length of the electric cylinder.

16. The holding module of claim 11, wherein the holding pin includes an upper pin and a lower pin, and a width of the holding pin is configured to be adjustable based on the lower pin retracting into the upper pin.

17. A method for operating a mounting equipment, the method comprising:

providing mounting equipment which includes a frame, a holder on the frame, the holder including a first supporter and a second supporter, the second supporter including a holding pin for holding a tape reel, and an electric cylinder on the frame, the electric cylinder connected to the holder and configured to move a position of the holder, wherein one end of the first supporter is on the frame, another end of the first supporter is connected to the electric cylinder, and one end of the second supporter is connected to the other end of the first supporter and the electric cylinder moving the holder from a first position to a second position lower than the first position by the electric cylinder to replace the tape reel; and moving the holder from the second position to the first position by the electric cylinder, based on the replacement of the tape reel being completed.

18. The method for operating the mounting equipment of claim 17, wherein the holding pin includes an upper pin and a lower pin, and a width of the holding pin is configured to be adjustable based on the lower pin retracting into the upper pin.

19. The method for operating the mounting equipment of claim 18, further comprising:

exerting a pressure on the lower pin in an axial direction of the holding pin to retract the lower pin, while a tape reel is being replaced; and pressing a holding hole of the replaced tape reel while the holding pin returns to an original state of the lower pin, based on the replaced tape reel being in place on the holding pin.

20. The method for operating the mounting equipment of claim 17, further comprising:

a base plate attached to the frame, wherein the base plate includes a first fixed hinge connected to the holder, and a second fixed hinge connected to the electric cylinder.

* * * * *